US008418625B2

(12) United States Patent
Czaloun

(10) Patent No.: US 8,418,625 B2
(45) Date of Patent: Apr. 16, 2013

(54) SYSTEM FOR CONVEYING PERSONS AND METHOD FOR OPERATING THE SYSTEM

(75) Inventor: Johann Czaloun, Meran (IT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 13/300,851

(22) Filed: Nov. 21, 2011

(65) Prior Publication Data

US 2012/0125223 A1 May 24, 2012

(30) Foreign Application Priority Data

Nov. 22, 2010 (AT) ..... A 1931/2010

(51) Int. Cl.
*B61B 12/12* (2006.01)

(52) U.S. Cl.
USPC ..... 104/204; 104/173.1; 104/173.2; 104/178

(58) Field of Classification Search ..... 104/173.1, 104/173.2, 178, 204
See application file for complete search history.

(56) References Cited

U.S. PATENT DOCUMENTS 3,610,164 A * 10/1971 Feuz ..... 104/154
3,871,303 A * 3/1975 Woodling ..... 104/173.1
4,092,929 A * 6/1978 Laurent ..... 104/173.1
4,669,389 A * 6/1987 Tarassoff ..... 104/173.2
5,406,891 A * 4/1995 Kunczynski ..... 104/173.1
5,419,261 A * 5/1995 Tarassoff et al. ..... 104/173.1
5,445,081 A * 8/1995 Kunczynski ..... 104/165
5,465,668 A * 11/1995 Tarassoff et al. ..... 104/95
5,517,923 A * 5/1996 Cathiard ..... 104/173.1
2012/0125223 A1* 5/2012 Czaloun ..... 104/204

FOREIGN PATENT DOCUMENTS

EP 0 611 220 A1 8/1994
EP 1 193 153 A1 4/2002

* cited by examiner

*Primary Examiner* — Jason C Smith
(74) *Attorney, Agent, or Firm* — Laurence A. Greenberg; Werner H. Stemer; Ralph E. Locher

(57) ABSTRACT

A system for conveying persons has at least one track along which a plurality of vehicles or groups of vehicles are moved by continuous conveying cables. At least two mutually successive conveying cables are arranged in line with one another and each has a drive so that they may be driven independently of one another. The vehicles are coupled to the cables with clamping devices. The clamping devices arranged on the vehicles spaced apart from one another in the longitudinal direction of the system. When there is a transfer of a vehicle from a first to the successive conveying cable, a control device uncouples at least the first clamping device, from the first conveying cable and thereupon couples it to the successive conveying cable. Then, a further clamping device is uncoupled from the first conveying cable and coupled to the successive conveying cable.

11 Claims, 10 Drawing Sheets

SYSTEM FOR CONVEYING PERSONS AND METHOD FOR OPERATING THE SYSTEM

CROSS-REFERENCE TO RELATED APPLICATION

This application claims the priority, under 35 U.S.C. §119, of Austrian patent application A 1931/2010, filed Nov. 22, 2010; the prior application is herewith incorporated by reference in its entirety.

BACKGROUND OF THE INVENTION

Field of the Invention

The present invention relates to a system for conveying persons. The system has at least one track along which a plurality of vehicles or groups of vehicles may be moved by means of continuous conveying cables, wherein at least two mutually successive conveying cables are provided, with each of which at least one drive is associated, as a result of which they may be driven independently of one another. The vehicles or groups of vehicles may be coupled to the conveying cables by way of clamping devices.

The present invention further relates to a method for operating a conveying system of this kind.

Prior systems of the generic kind for conveying persons are described, for example, in U.S. Pat. No. 5,419,261 and its counterpart European patent EP 0 611 220 B1 and in European patent EP 1 193 153 B1. Those systems have two tracks along which vehicles may be moved by way of continuous conveying cables with which drives are associated. Because the vehicles are coupled to the conveying cables associated therewith, movement of the vehicles is controlled by the drives of the conveying cables. Because these conveying cables are limited to approximately 2000 m in length, it is further known to provide, in each of the two directions of travel and mutually successively, at least two continuous conveying cables. This makes it possible on the one hand to construct such systems for conveying persons to have any desired length. Because the vehicles are coupled to the individual conveying cables, on the other hand this also makes it possible to control the movement of the individual vehicles independently of one another. Stopping the drive of one of the conveying cables thus brings the vehicles coupled to this conveying cable to a standstill, as a result of which passengers can disembark or embark.

In the prior art system of this kind, when the vehicles are moved it is necessary to uncouple each of them from a conveying cable at the end thereof which is in the direction of movement and to couple them to the following conveying cable. To make this possible, it is known to arrange the end regions of the two conveying cables next to one another and furthermore to construct the at least one clamping device that is provided on the vehicles to be movable transversely to the direction of movement. As soon as the vehicle concerned reaches the end of the first conveying cable, it is uncoupled from the first conveying cable, the clamping device is moved transversely to the course of the two conveying cables, and the vehicle is coupled to the next conveying cable. As a result, as the procedure continues, the vehicle is further moved by the next conveying cable.

SUMMARY OF THE INVENTION

It is accordingly an object of the invention to provide a system for transporting persons and a method of operating the system which overcome a variety of disadvantages associated with the heretofore-known devices and methods of this general type and which provides for a person-conveying system in which it is not necessary to arrange two mutually successive conveying cables next to one another in the end regions thereof and to provide a coupling device that is movable transversely.

With the foregoing and other objects in view there is provided, in accordance with the invention, a system for conveying persons, comprising:

a track for supporting thereon a plurality of vehicles or groups of vehicles;

continuous conveying cables for moving the vehicles along said track, said conveying cables including a first conveying cable and at least one successive conveying cable, each said cable having at least one respective drive associated therewith for driving said conveying cables independently of one another;

said at least one successive conveying cable following said first conveying cable in a longitudinal direction of the conveying system substantially in line therewith;

a plurality of clamping devices mounted to the vehicles or the groups of vehicles for coupling the vehicles or the groups of vehicles to said conveying cables, said clamping devices being mounted to the vehicles or groups of vehicles with at least two said clamping devices spaced apart from one another in the longitudinal direction; and a control device configured to control said clamping devices, for a transfer of a vehicle from said first conveying cable to said successive conveying cable, by decoupling at least one forward said clamping device, as seen in a direction of travel of the vehicle, from said first conveying cable and subsequently coupling said forward clamping device to said successive conveying cable and, in a continuing process, decoupling at least one further said clamping device from said first conveying cable and subsequently coupling said further clamping device to said successive conveying cable.

In other words, the objects of the invention are achieved in that the at least two mutually successive conveying cables are arranged such that they succeed one another in the longitudinal direction of the system at least approximately in a line (i.e., in line, coaxially aligned, etc.), in that the vehicles are constructed to have at least two clamping devices which are arranged spaced apart from one another in the longitudinal direction of the system, and in that a control device is provided which, when there is a transfer of a vehicle from one conveying cable to the successive conveying cable, uncouples at least the first clamping device, as seen in the direction of travel, from the first conveying cable and thereupon couples it to the successive conveying cable and, as the procedure continues, the at least one further clamping device is similarly uncoupled from the first conveying cable and thereupon coupled to the successive conveying cable.

Preferably, the control device is a control rail which, on movement of the vehicle, puts the clamping devices located on the latter into their open position, as a result of which the vehicle is uncoupled from the first conveying cable and, as the procedure continues, is coupled to the successive conveying cable. Here, the control rail may be constructed to have preferably wedge-shaped control ramps at its two ends.

Preferably, the two control ramps are furthermore pivotal and, by means of servo devices, adjustable in height.

According to a further preferred embodiment, a conveying device is provided by which the vehicle uncoupled from the conveying cables may be moved. This conveying device may be formed by at least one drive tire which acts on a control face of the vehicle. Furthermore, a respective control roll which is borne on a control lever and runs on the control rail is preferably associated with the clamping devices, as a result of which the clamping devices are put into their open positions.

With the above and other objects in view there is also provided, in accordance with the invention, a method for operating a system for conveying persons. As above, the system has at least one track along which a plurality of vehicles or groups of vehicles may be moved by means of a plurality of continuous conveying cables, wherein at least two mutually successive conveying cables are provided, with each of which at least one drive is associated, as a result of which they may be driven independently of one another, and to which the vehicles or groups of vehicles may be coupled by means of clamping devices, according to the invention the at least two mutually successive conveying cables are arranged such that they succeed one another in the longitudinal direction of the system at least approximately in a line, the vehicles or groups of vehicles are constructed to have at least two clamping devices which are arranged spaced apart from one another in the longitudinal direction of the system, and a control device is provided which, when there is a transfer of a vehicle or group of vehicles from a first conveying cable to the further conveying cable succeeding it, uncouples at least the first clamping device, as seen in the direction of travel, from the first conveying cable and thereupon couples it to the successive conveying cable and, as the procedure continues, uncouples the at least one further clamping device from the first conveying cable and thereupon couples it to the further conveying cable.

Preferably, the vehicle is brought to a standstill in the region of a control rail and furthermore the conveying cables are also stopped, whereupon control ramps are pivoted, which has the result that at least the first clamping device, as seen in the direction of movement of the vehicle, is coupled to the conveying cable and the successive clamping devices are uncoupled from the first conveying cable and the successive conveying cable is driven, whereupon the further clamping devices are coupled mutually successively to the successive conveying cable. As an alternative to this, the two conveying cables may be driven at the same speeds, wherein moving the vehicle beyond a control rail has the effect of mutually successively uncoupling the individual clamping devices from the first conveying cable and coupling them to the successive conveying cable. Furthermore, moving the vehicle over a control rail can have the effect of opening all the clamping devices, as a result of which the vehicle is uncoupled from the first conveying cable, it is furthermore moved on by a conveying device, and thereupon the clamping devices are put mutually successively into their closed position, as a result of which the vehicle is coupled to the successive conveying cable.

Other features which are considered as characteristic for the invention are set forth in the appended claims.

Although the invention is illustrated and described herein as embodied in a system for conveying persons and method for operating this system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
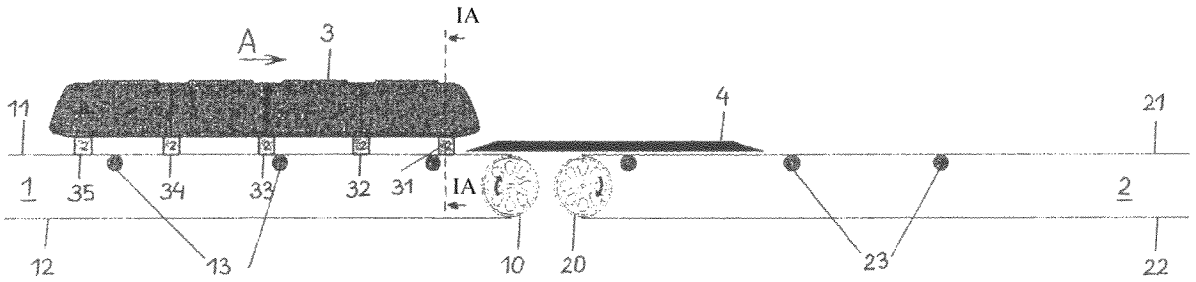
FIG. 1 shows a portion of a system according to the invention for conveying persons, at a first stage of the transfer of a vehicle from a first conveying cable to the successive conveying cable.
Figure 1A:
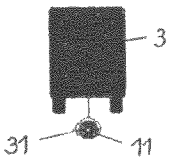
FIG. 1A shows a section along the line IA-IA in FIG. 1.

Referring now to the figures of the drawing in detail and first, particularly, to FIGS. 1 to 4 thereof, there is shown a system according to the invention for conveying persons in which there is provided a continuous conveying cable 1 and, succeeding the latter approximately along a straight line, a second continuous conveying cable 2. A system of this kind may include any number of mutually successive conveying cables in each of the directions of travel.

At its ends, the first conveying cable 1 is laid over cable drums 10 which are borne to rotate about a substantially horizontal axis. The conveying cable 1 has an upper run 11 and a lower run 12. At its ends, the second conveying cable 2 is laid over cable drums 20 which are similarly borne to rotate about an at least approximately horizontally aligned axis, wherein the second conveying cable 2 also has an upper run 21 and a lower run 22. Associated with at least one of the cable drums 10 and 20 is a respective drive, by which the two conveying cables 1 and 2 may be moved. The two upper runs 11 and 21 of the two conveying cables 1 and 2 are guided by way of cable carrying rolls 13 and 23.

A plurality of vehicles 3 may be moved along a track by means of the two conveying cables 1 and 2. For this purpose, the vehicles 3 are constructed to have a plurality of clamping devices 31, 32, 33, 34 and 35 which are spaced apart from one another in the direction of movement and which may be coupled to the respective upper cable runs 11 and 21 of the conveying cables 1 and 2, as a result of which the vehicles 3 may be moved in the direction of the arrow A. In the region of the transfer of the vehicles 3 from the first conveying cable 1 to the successive conveying cable 2, there is furthermore provided a device 4 for controlling the clamping devices 31 to 35.

During the operation of a system of this kind, when the vehicles 3 are moved and during their transfer from the first conveying cable 1 to the second conveying cable 2, the clamping devices 31 to 35 are opened mutually successively, as a result of which they are uncoupled from the upper run 11 of the first conveying cable 1, and are closed again mutually successively, as a result of which they are coupled to the upper run 21 of the second conveying cable 2, as a result of which the vehicles 3 are moved first by the conveying cable 1 and, as the procedure continues, by the second conveying cable 2.

In the operational phase illustrated in FIG. 1, the vehicle 3 is coupled to the upper cable run 11 of the first conveying cable 1 by means of all the coupling devices 31 to 35.

Figure 2:
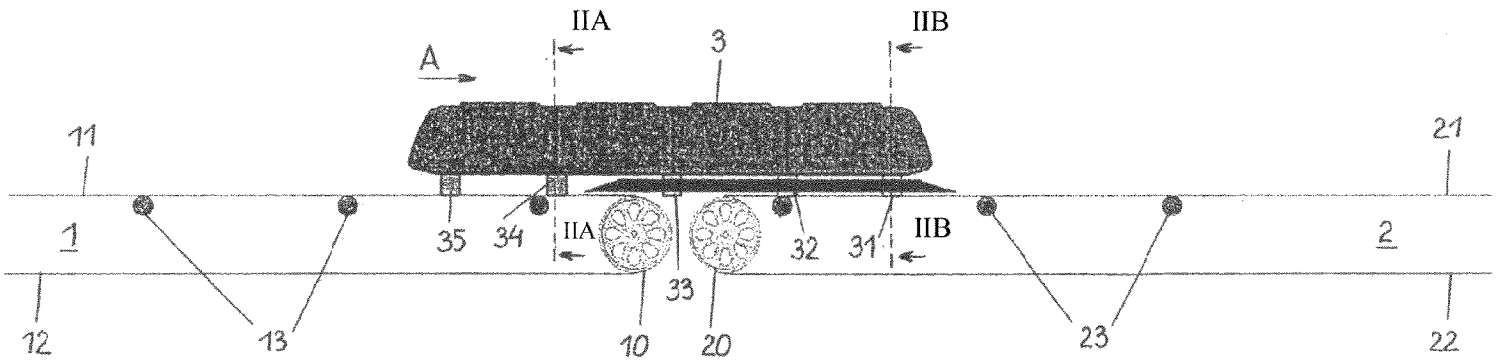
FIG. 2 shows a portion of the system according to FIG. 1, at a second stage of the transfer of a vehicle from a first conveying cable to the successive conveying cable.
Figure 2B:
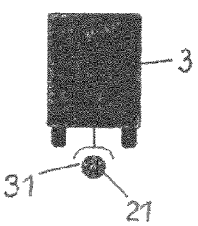
FIG. 2B shows a section along the line IIB-IIB in FIG. 2.
Figure 2A:
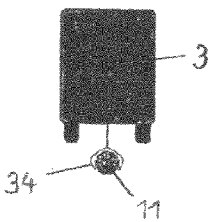
FIG. 2A shows a section along the line IIA-IIA in FIG. 2.

In the operational phase illustrated in FIG. 2, the clamping devices 31 to 33 are opened successively by the control device 4, whereas the clamping devices 34 and 35 continue to be coupled to the upper cable run 11 of the conveying cable 1.

Figure 3:
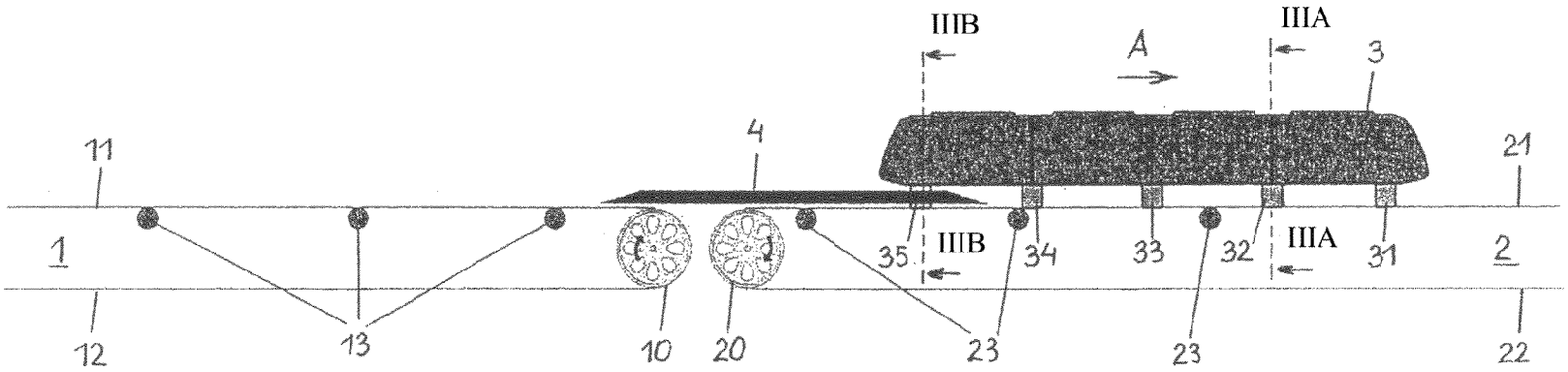
FIG. 3 shows a portion of the system according to FIG. 1, at a third stage of the transfer of a vehicle from a first conveying cable to the successive conveying cable.
Figure 3B:
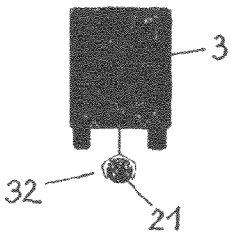
FIG. 3B shows a section along the line IIIB-IIIB in FIG. 3.
Figure 3A:
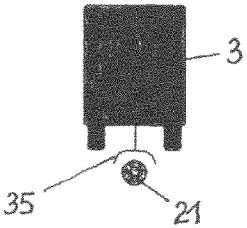
FIG. 3A shows a section along the line IIIA-IIIA in FIG. 3.

In the operational phase illustrated in FIG. 3, as the vehicle 3 moves on, the clamping devices 31 to 34 are coupled successively to the upper cable run 21 of the second conveying cable 2 and the clamping device 35 is opened, as a result of which the vehicle 3 is coupled to the upper run 21 of the second conveying cable 2 and is uncoupled from the upper run 11 of the first conveying cable 1.

Figure 4:
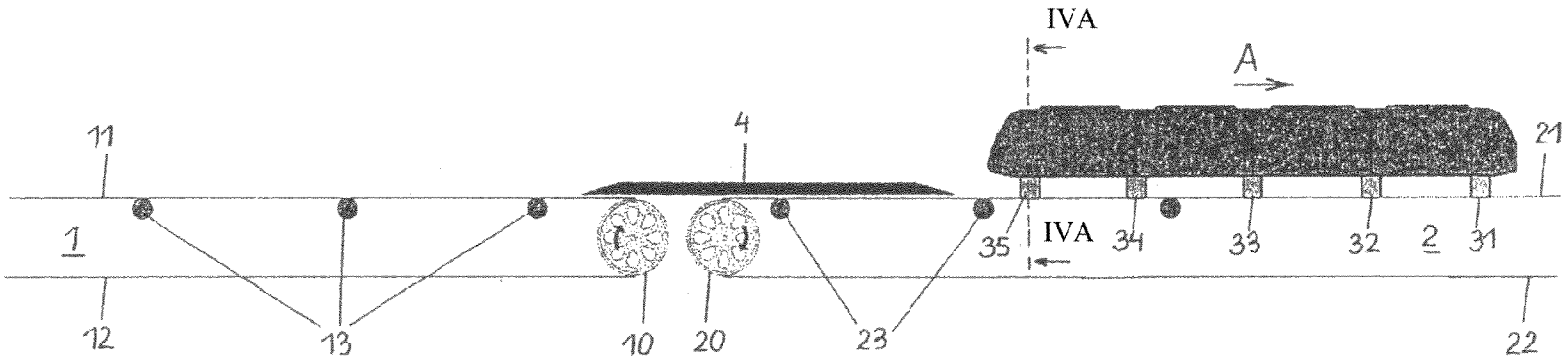
FIG. 4 shows a portion of the system according to FIG. 1, at a fourth stage of the transfer of a vehicle from a first conveying cable to the successive conveying cable.
Figure 4A:
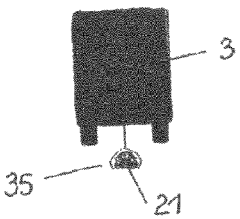
FIG. 4A shows a section along the line IVA-IVA in FIG. 4.

In the operational phase illustrated in FIG. 4, all the clamping devices 31 to 35 are closed, as a result of which the vehicle 3 is coupled by means of all the clamping devices 31 to 35 to the upper run 21 of the second conveying cable 2 and is moved by the latter.

Instead of individual vehicles, groups of vehicles may also be provided.

A first embodiment of a system according to the invention is explained below in more detail.

Figure 5:
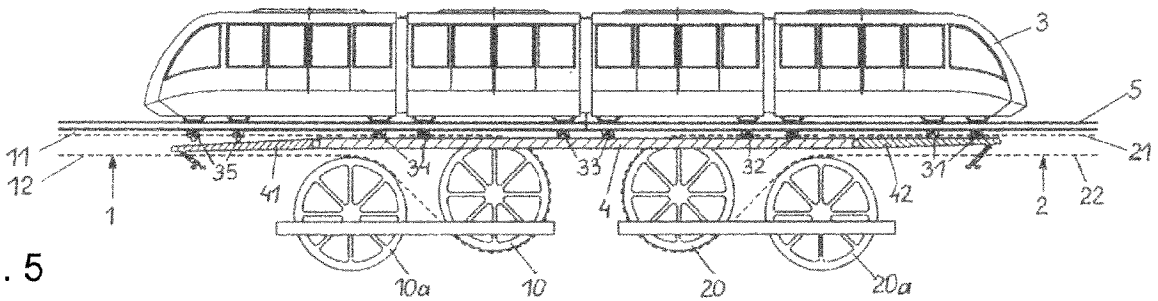
FIG. 5 shows side view of a first embodiment of a device for controlling the clamping devices in a system according to the invention, at a first stage of the coupling procedure.
Figure 5A:
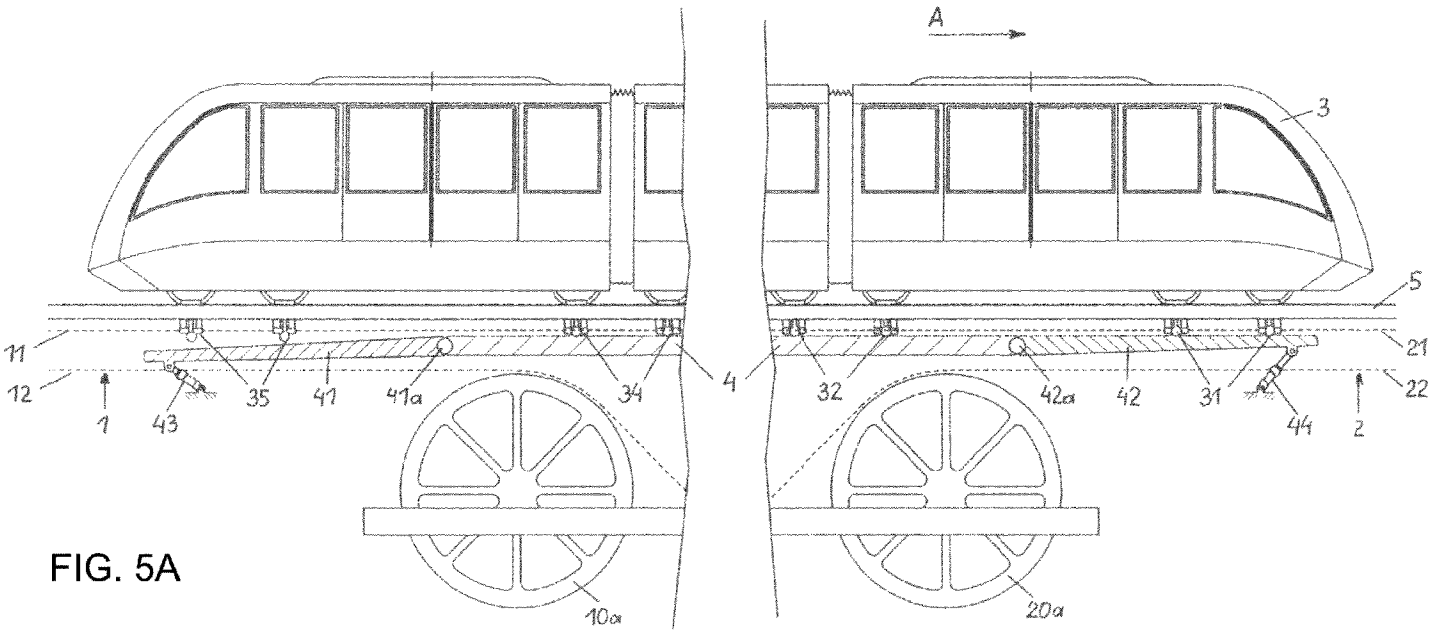
FIG. 5A shows the device according to FIG. 5, on a larger scale than FIG. 5.

As can be seen from FIG. 5 and FIG. 5A, the system has a track 5 which is preferably formed by two rails and along which at least one vehicle 3 may be moved. For this purpose, a first conveying cable 1 is provided which is guided, at the end thereof illustrated in the drawing, by way of a return drum 10 and a deflection drum 10*a*. Adjoining this first conveying cable 1 in a straight line is a second conveying cable 2 which is guided, at the beginning thereof illustrated in the drawing, by way of a return drum 20 and a deflection drum 20*a*. The two conveying cables 1 and 2 each have an upper cable run 11 and 21 respectively and a lower cable run 12 and 22 respectively. The vehicle 3 is constructed to have pairs of clamping devices 31, 32, 33, 34 and 35 by means of which it may be coupled to the respective upper run 11 and 21 of the two conveying cables 1 and 2 respectively. To actuate the clamping devices 31 to 35 there is provided a control rail 4, on the two ends thereof there are provided control ramps 41 and 42 which are pivotal about horizontal axes 43*a* and 44*a* by means of servo cylinders 43 and 44 which are associated with these control ramps 41 and 42.

When the system is in operation, the vehicle 3 is moved in the direction of the arrow A, into the region of the transfer between the two conveying cables 1 and 2. During this, control rolls of the clamping devices 31 to 34 run, mutually successively, over the first control ramp 41, which is in its lower pivotal position, onto the control rail 4 and onto the second control ramp 42, which is in its upper pivotal position, as a result of which the clamping devices 31 to 34 are put into their open position and kept in it, whereas the clamping device 35 remains coupled to the first conveying cable 1. In this position of the vehicle 3 the first conveying cable 1 is stopped.

It is this position which is illustrated in FIG. 5 and FIG. 5A.

Figure 6:
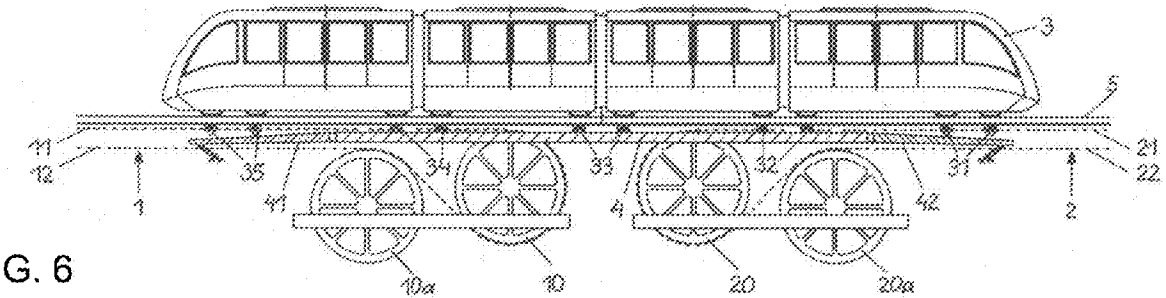
FIG. 6 shows a side view of the device according to FIG. 5 at a second stage of the coupling procedure.
Figure 6A:
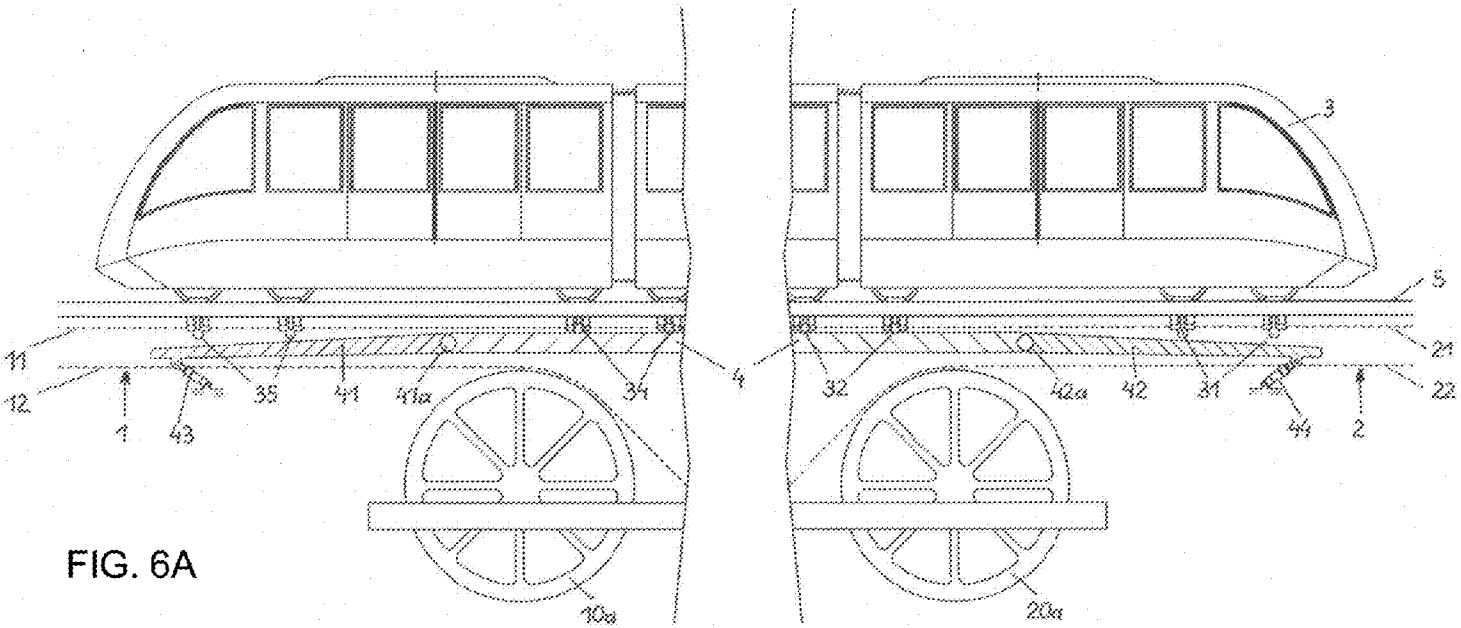
FIG. 6A shows the device according to FIG. 6, on a larger scale than FIG. 6.

As the procedure continues, the second control ramp 42 of the control rail 4 is pivoted into its lower pivotal position, as a result of which the clamping devices 31 move from their open position into their closed position, as a result of which the vehicle 3 is coupled to the second conveying cable 2, which is similarly not moved. This position is illustrated in FIG. 6 and FIG. 6A.

Figure 7:
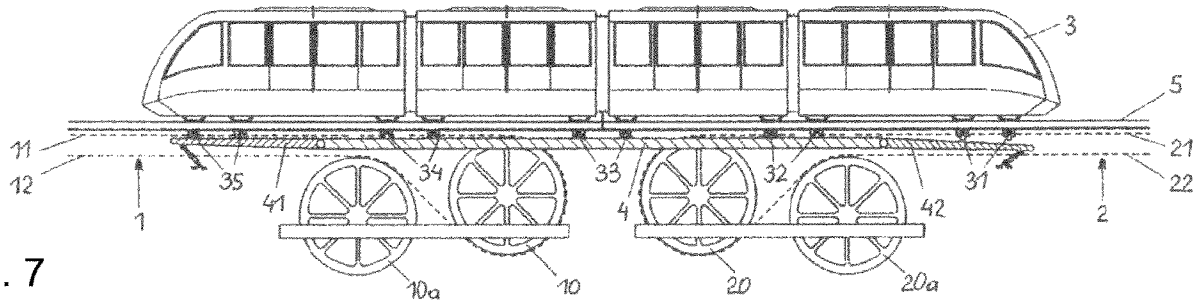
FIG. 7 shows a side view of the device according to FIG. 5 at a third stage of the coupling procedure.
Figure 7A:
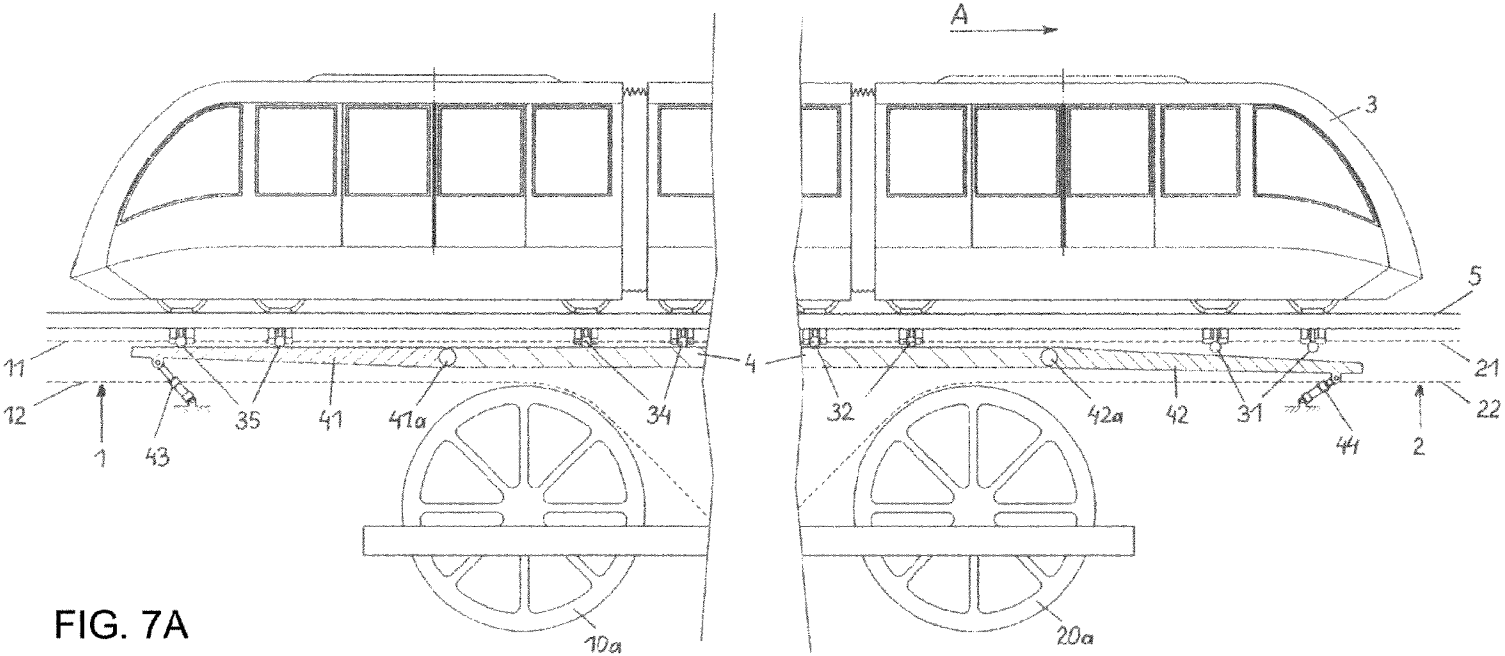
FIG. 7A shows the device according to FIG. 7, on a larger scale than FIG. 7.

As the procedure continues, the first control ramp 41 is pivoted into its upper position, as a result of which the clamping devices 35 are also uncoupled from the first conveying cable 1. This position is illustrated in FIG. 7 and FIG. 7A.

The second conveying cable 2 is thereupon driven again, and as soon as this happens the vehicle 3 is moved on in the direction of the arrow A. Thereupon, the clamping devices 32 to 35 move mutually successively into their closed position, as a result of which the vehicle 3 is also coupled by means of the clamping devices 32 to 35 to the second conveying cable 2.

Figure 8:
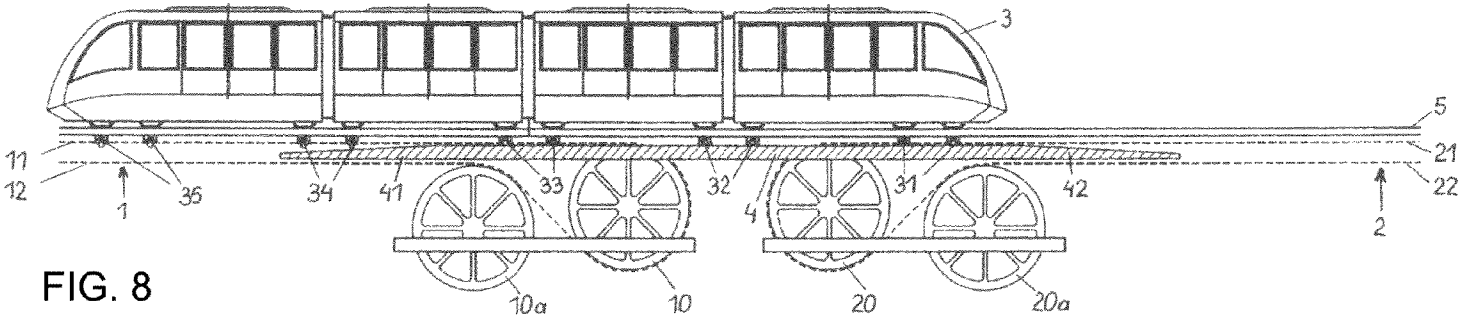
FIG. 8, FIG. 8A and FIG. 8B show side views of a second embodiment of a device for controlling the clamping devices in a system according to the invention, in three mutually successive stages of the coupling procedure.
Figure 8A:
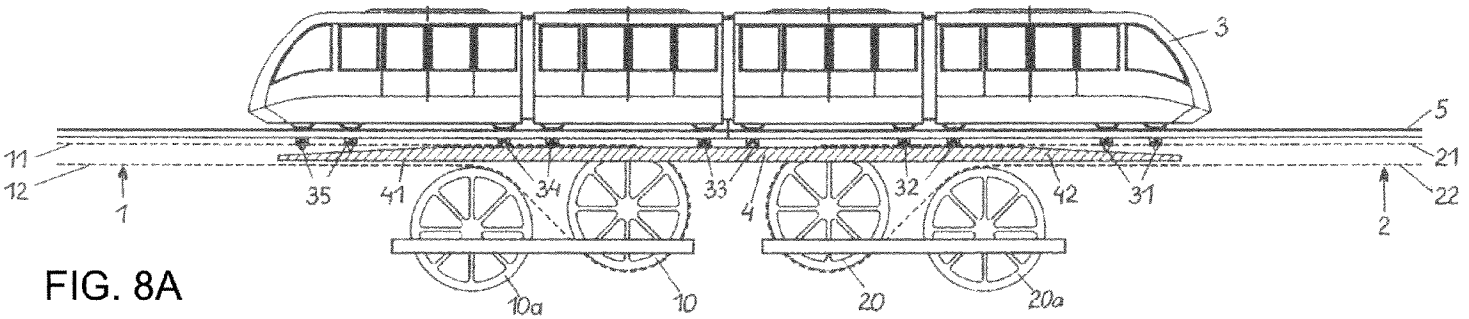
Figure 8B:
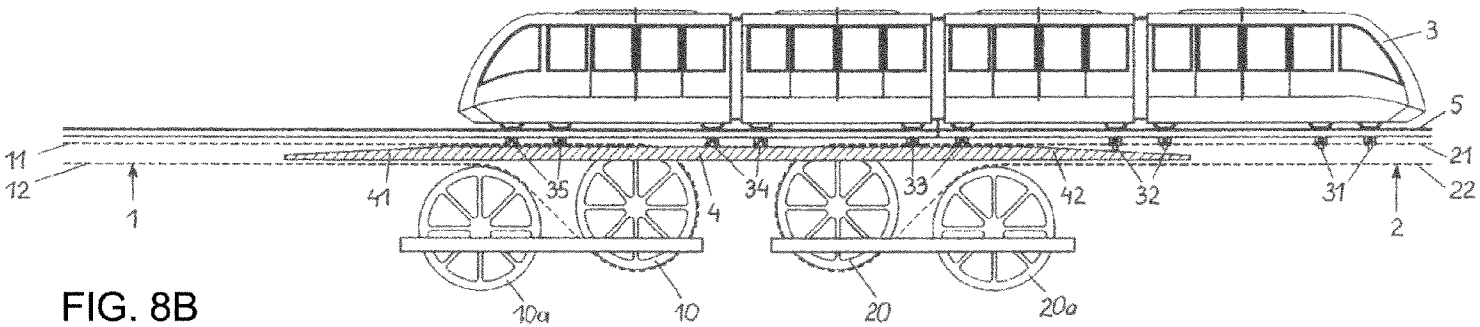

In the second embodiment, illustrated in FIG. 8, FIG. 8A and FIG. 8B, the control rail 4 is constructed to have, at its beginning and end, fixed control ramps 41 and 42 which control the pairs of clamping devices 31 to 35 by means of the movement of the vehicles 3 over the control rail 4. In this case, the two conveying cables 1 and 2 are driven at the same speed, wherein during the transfer from the first conveying cable 1 to the second conveying cable 2 the vehicle 3 is moved at the speed of the two conveying cables 1 and 2. On passing over the control rail 4, the clamping devices 31 to 35 are moved mutually successively into their open position by the first control ramp 41, as a result of which they are uncoupled from the first conveying cable 1, and are kept in the open position by the control rail 4. As soon as they reach the region of the second control ramp 42, they are put back into the closed position, as a result of which the vehicle 3 is coupled to the second conveying cable 2.

In this embodiment, it is imperative that the two conveying cables 1 and 2 move synchronously. In this embodiment too, the vehicle 3 can also be stopped by switching off the drives for the conveying cables 1 and 2 in order to enable passengers to get on and off.

Figure 9:
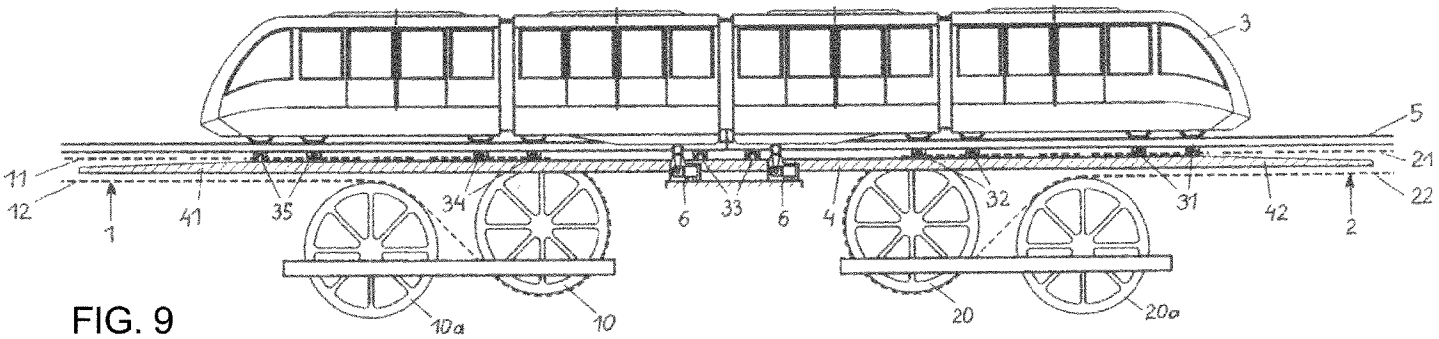
FIG. 9 shows a side view of a third embodiment of a device for controlling the clamping devices in a system according to the invention.
Figure 9A:
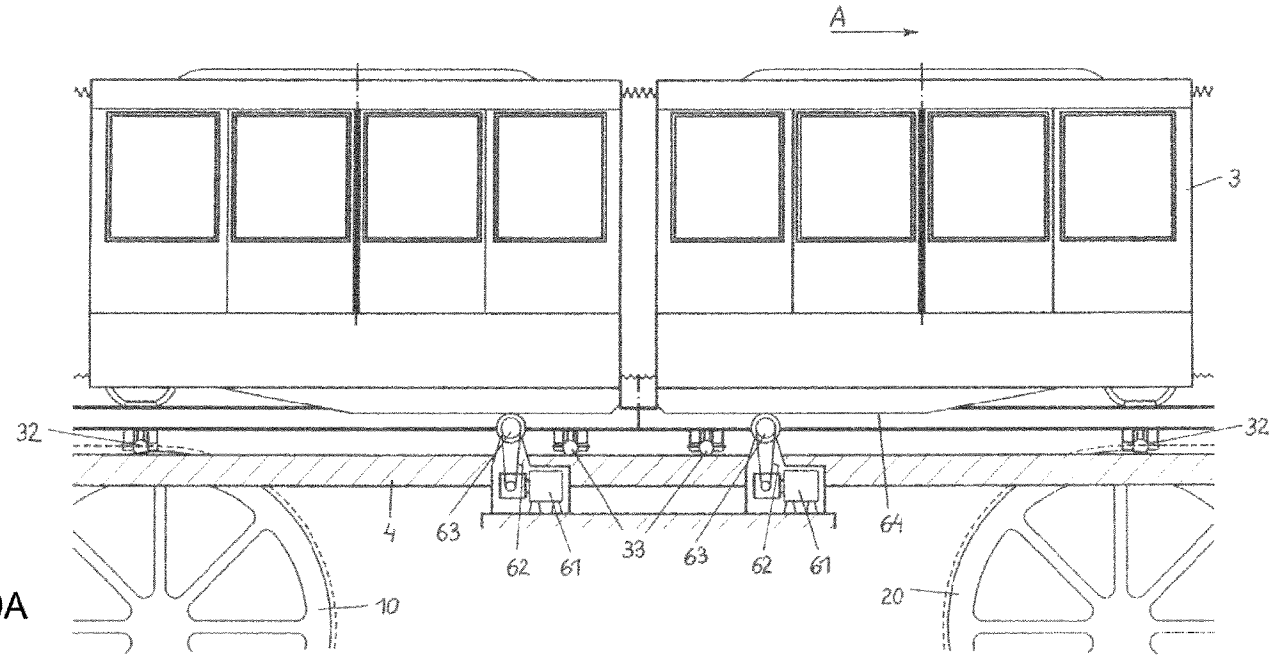
FIG. 9A shows the device according to FIG. 9, on a larger scale than FIG. 9.

In the third embodiment, illustrated in FIG. 9 and FIG. 9A, there is provided in the region of the transfer from the first conveying cable 1 to the second conveying cable 2 at least one conveying device 6 by means of which, while the vehicle 3 is at the stage in which it is uncoupled from the first conveying cable 1 and not yet coupled to the second conveying cable 2, it is moved in the direction of the arrow A until it is coupled to the second conveying cable 2. The conveying device is formed by two drive motors 61 which, by way of V belts 62, drive at least one drive roll 63, which acts on a drive face 64 of the vehicle 3.

Figure 10:
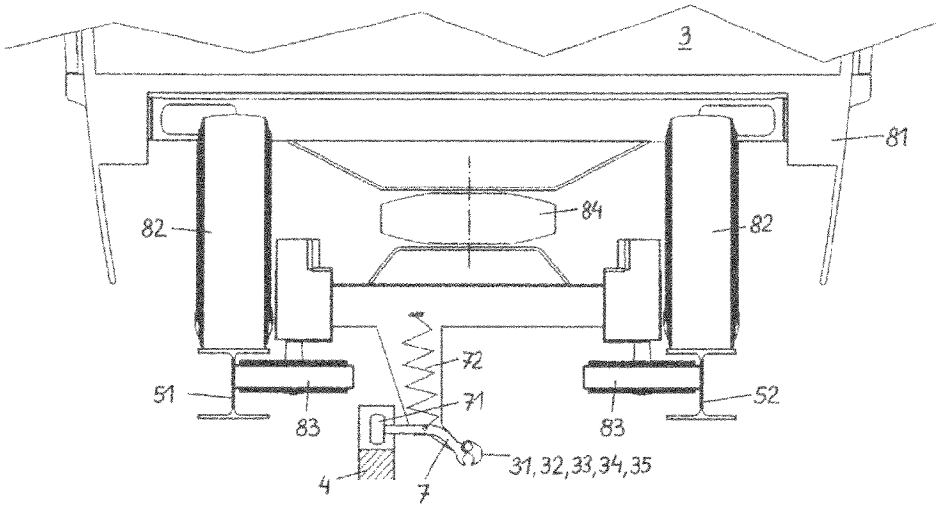
FIG. 10 and FIG. 10A show cross sections through the device for controlling the clamping devices of the embodiments according to FIG. 5 to FIG. 9A.
Figure 10A:
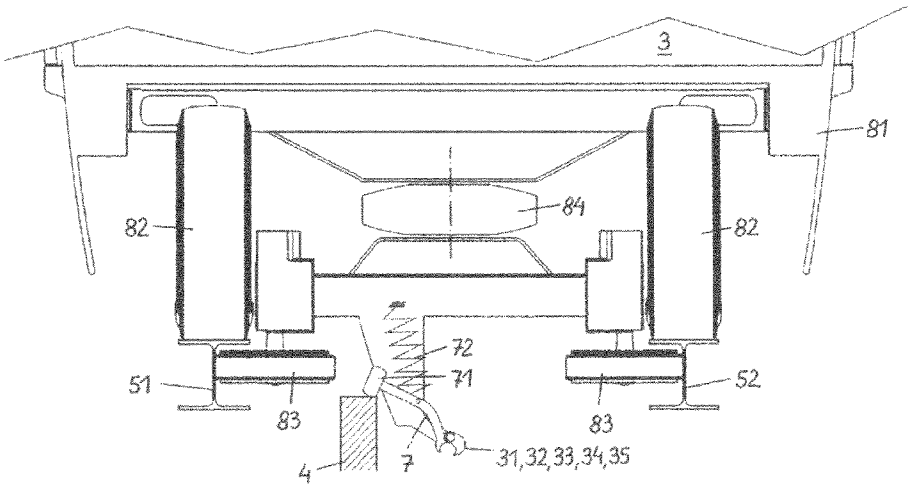

As can be seen from FIG. 10 and FIG. 10A, clamping devices 31 to 35 located on the vehicle 3 are constructed to have a control lever 7 on which a control roll 71 is borne. The control roll 71 is acted upon by a pressure spring 72 which moves the clamping devices 31 to 35 into their closed position. As soon as the control roll 71 runs onto the control rail 4, the control lever 7 is displaced in opposition to the pressure spring 72 such that the clamping devices 31 to 35 move into their open position, as a result of which the vehicle 3 is uncoupled from the conveying cables.

The vehicle 3 is constructed to have a vehicle bogie 81, wheels 82 which run on rails 51 and 52 of the track 5, guide rolls 83 and shock-absorbing elements 84.

The invention claimed is:

1. A system for conveying persons, comprising:

a track for supporting thereon a plurality of vehicles or groups of vehicles;

continuous conveying cables for moving the vehicles along said track, said conveying cables including a first conveying cable and at least one successive conveying cable, each said cable having at least one respective drive associated therewith for driving said conveying cables independently of one another;

said at least one successive conveying cable following said first conveying cable in longitudinal and transverse alignment therewith along a straight line;

a plurality of clamping devices mounted to the vehicles or the groups of vehicles for coupling the vehicles or the groups of vehicles to said conveying cables, said clamping devices being mounted to the vehicles or groups of vehicles with at least two said clamping devices spaced apart from one another in the longitudinal direction and transversely aligned with one another; and a control device configured to control said clamping devices, for a transfer of a vehicle from said first conveying cable to said successive conveying cable, by decoupling at least one forward said clamping device, as seen in a direction of travel of the vehicle, from said first conveying cable and subsequently coupling said forward clamping device to said successive conveying cable and, in a continuing process, decoupling at least one further said clamping device from said first conveying cable and subsequently coupling said further clamping device to said successive conveying cable.

2. The system according to claim 1, wherein said control device comprises a control rail which, on movement of the vehicle, moves said clamping devices mounted on the vehicle into their open position, so as to uncouple the vehicle from said first conveying cable and subsequently coupling the vehicle to said successive conveying cable.

3. The system according to claim 2, wherein said control rail two ends constructed with wedge-shaped control ramps.

4. The system according to claim 3, wherein said two control ramps are pivotally mounted for height-adjustment by way of servo devices.

5. The system according to claim 1, which further comprises a conveying device disposed to move the vehicle while the vehicle is uncoupled from said conveying cables.

6. The system according to claim 5, wherein said conveying device comprises at least one drive tire disposed to act on a control face of the vehicle.

7. The system according to claim 1, wherein said control device comprises a control rail, and wherein a respective control roll is mounted to a control lever and disposed to run on said control rail, and wherein said control lever is associated with said clamping devices so as to move said clamping devices into an open position.

8. A method of operating a system for conveying persons, the system having at least one track along which a plurality of vehicles or groups of vehicles may be moved by a plurality of continuous conveying cables, the method which comprises:

providing at least two mutually successive conveying cables arranged in succession in longitudinal and transverse alignment therewith along a straight line, and driving the conveying cables independently of one another;

providing the plurality of vehicles or groups of vehicles with at least two clamping devices configured to couple the vehicles to the conveying cables, the at least two clamping devices being spaced from one another in the longitudinal direction and transversely aligned with one another; and driving a control device during a transfer of a vehicle or group of vehicles from one conveying cable to a following conveying cable, to cause a forward clamping device, as seen in the direction of travel, to uncouple from the one conveying cable and thereupon to couple the forward clamping device to the following conveying cable and, in a continuing process, to uncouple a further clamping device from the one conveying cable and thereupon to couple the further clamping device to the following conveying cable.

9. The method according to claim 8, wherein the control device includes a control rail and control ramps and the method further comprises bringing the vehicle to a standstill in a region of the control rail and stopping the conveying cables, thereupon pivoting the control ramps, resulting in at least the first clamping device, as seen in the direction of movement of the vehicle, to be coupled to the conveying cable and the successive clamping devices to be uncoupled from the first conveying cable, and driving the following conveying cable, whereupon the further clamping devices are coupled mutually successively to the following conveying cable.

10. The method according to claim 8, which comprises:

driving the two conveying cables at an equal speed; and moving the vehicle past a control rail so as to successively uncouple the individual clamping devices from the first conveying cable and to successively couple the clamping devices to the following conveying cable.

11. The method according to claim 8, which comprises:

moving the vehicle over a control rail to thereby open all of the clamping devices and, as a result, to uncouple the vehicle from the first conveying cable;

moving the vehicle with a conveying device; and thereupon moving the clamping devices mutually successively into their closed position, to thereby cause the vehicle to be coupled to the following conveying cable.

* * * * *